US009255474B2

(12) United States Patent
Sroka

(10) Patent No.: US 9,255,474 B2
(45) Date of Patent: Feb. 9, 2016

(54) FLEXIBILITY OF DOWNHOLE FLUID ANALYZER PUMP MODULE

(75) Inventor: Stefan Sroka, Adelheidsdorf, DE (US)

(73) Assignee: Baker Hughes Incorporated, Houston, TX (US)

( * ) Notice: Subject to any disclaimer, the term of this patent is extended or adjusted under 35 U.S.C. 154(b) by 577 days.

(21) Appl. No.: 13/544,018

(22) Filed: Jul. 9, 2012

(65) Prior Publication Data

US 2014/0008060 A1 Jan. 9, 2014

(51) Int. Cl.
*E21B 49/10* (2006.01)
*E21B 49/08* (2006.01)

(52) U.S. Cl.
CPC ..... *E21B 49/10* (2013.01); *E21B 2049/085* (2013.01)

(58) Field of Classification Search
CPC ..... E21B 49/10; E21B 47/00; E21B 43/00; E21B 2049/085
USPC ..... 166/369, 66.4, 105, 264; 417/423.3, 417/423.7, 411; 310/87, 68 A
See application file for complete search history.

(56) References Cited

U.S. PATENT DOCUMENTS 5,303,775 A * 4/1994 Michaels et al. ..... 166/264
5,322,971 A * 6/1994 Owen ..... 174/50
2002/0105301 A1 8/2002 Bush et al.
2008/0061647 A1 3/2008 Schmitt
2008/0116839 A1 5/2008 Hoemann
2008/0128128 A1* 6/2008 Vail et al. ..... 166/250.15
2008/0286131 A1* 11/2008 Yuratich et al. ..... 417/410.1
2009/0277628 A1 11/2009 Watson et al.
2010/0064794 A1* 3/2010 Jackson et al. ..... 73/152.02

FOREIGN PATENT DOCUMENTS

EP 2077374 A1 7/2009

OTHER PUBLICATIONS

Notification of Transmittal of the International Search Report and the Written Opinion of the International Searching Authority, or the Declaration; PCT/US2013/049539; International filed: Jul. 8, 2013; Date of mailing: Sep. 25, 2013; 13 pages.
Peter Weinheber, Optimizing Hardware Options for Maximum Flexibility and Improved Success in Wireline Formation Testing, Sampling and Downhole Fluid Analysis Operations, SPE 119713, Aug. 4-6, 2008, pp. 1-11, Abuja, Nigeria.

* cited by examiner

*Primary Examiner* — Jennifer H Gay
*Assistant Examiner* — David Carroll
(74) *Attorney, Agent, or Firm* — Cantor Colburn LLP

(57) ABSTRACT

An apparatus for pumping a downhole fluid includes a carrier configured to be conveyed through a borehole penetrating the earth and a pump disposed at the carrier and configured to pump the downhole fluid. A multi-phase electric motor is coupled to the pump and configured to receive multi-phase electrical energy from a power source in order to operate the pump. The multi-phase electrical motor includes multiple windings and a switch configured to connect the multiple windings in a configuration selected from a plurality of configurations. The plurality of configurations includes (i) a first configuration where one terminal of each winding of the multiple windings is uniquely connected to one terminal of another winding and (ii) a second configuration where one terminal of each winding of the multiple windings is commonly connected to one terminal of each of the other windings.

16 Claims, 5 Drawing Sheets

FLEXIBILITY OF DOWNHOLE FLUID ANALYZER PUMP MODULE

BACKGROUND

Geologic formations are used for many applications such as hydrocarbon production, geothermal production, and carbon dioxide sequestration. Typically, boreholes are drilled into the formations to provide access to them. Various tools may be conveyed in the boreholes in order to characterize the formations. Formation characterization provides valuable information related to the intended use of the formation so that drilling and production resources can be used efficiently.

One type of downhole tool is a fluid analyzer tool. The fluid analyzer tool seals a portion of the borehole wall using a packer or a pad sealing element. A pump then draws a sample of formation fluid from the formation and places it into a fluid analyzer module for analysis or a sample chamber for retrieval from the borehole. Because boreholes generally have a small diameter on the order of about six to eight inches in some embodiments, certain spatial constraints, which can limit functionality, are imposed on the tool. Hence, it would be appreciated in the drilling industry if fluid analyzer tools could be improved.

BRIEF SUMMARY

Disclosed is an apparatus for pumping a downhole fluid. The apparatus includes: a carrier configured to be conveyed through a borehole penetrating the earth; a pump disposed at the carrier and configured to pump the downhole fluid; a multi-phase electric motor coupled to the pump and configured to receive multi-phase electrical energy from a power source in order to operate the pump, the multi-phase electrical motor having multiple windings; and a switch configured to connect the multiple windings in a configuration selected from a plurality of configurations that includes (i) a first configuration where one terminal of each winding of the multiple windings is uniquely connected to one terminal of another winding and (ii) a second configuration where one terminal of each winding of the multiple windings is commonly connected to one terminal of each of the other windings.

Also disclosed is a method for pumping a downhole fluid. The method includes: conveying a carrier through a borehole penetrating the earth; selecting a configuration of multiple windings of a multi-phase electric motor disposed at the carrier from a plurality of configurations using a switch, the plurality of configurations having (i) a first configuration where one terminal of each winding of the multiple windings is uniquely connected to one terminal of another winding and (ii) a second configuration where one terminal of each winding of the multiple windings is commonly connected to one terminal of each of the other windings; energizing the multi-phase electric motor with the windings in the selected configuration to operate a pump coupled to the motor in order to pump the downhole fluid.

Further disclosed is an apparatus configured for operation in a borehole penetrating the earth. The apparatus includes: a carrier configured to be conveyed through the borehole; a multi-phase electric motor disposed at the carrier and configured to receive multi-phase electrical energy from a power source in order to operate the multi-phase electric motor, the multi-phase electric motor having multiple windings; and a switch configured to electrically energize the multiple windings in a configuration selected from a plurality of configurations.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the Figures.

Figure 1:
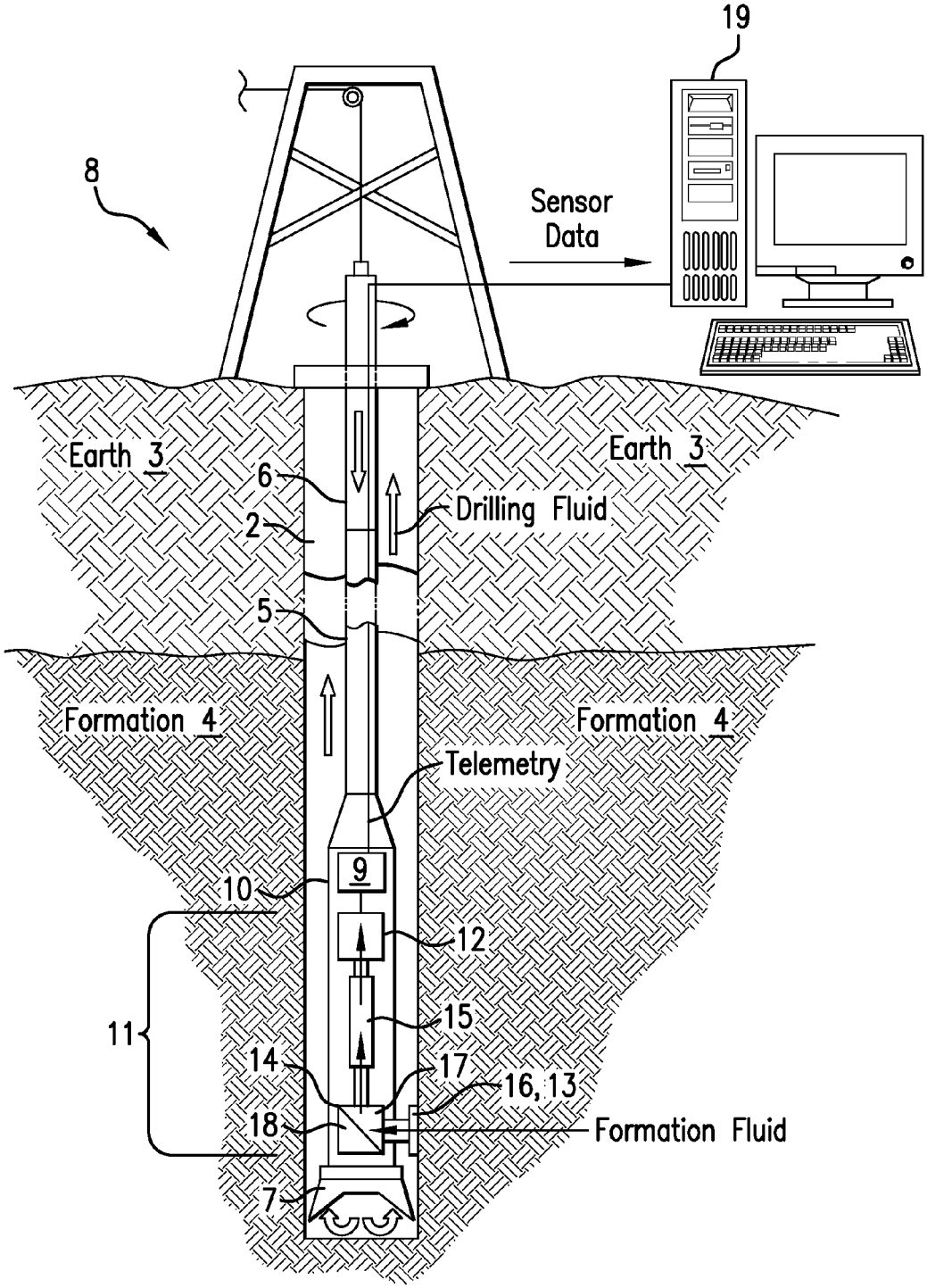
FIG. 1 illustrates an exemplary embodiment of a downhole tool conveyed in a borehole penetrating the earth by a drill string.

FIG. 1 illustrates a cross-sectional view of an exemplary embodiment of a system to estimate a property of a downhole fluid of interest. A bottomhole assembly (BHA) 10 is disposed in a borehole 2 penetrating the earth 3, which includes an earth formation 4. The BHA 10, which may also be referred to as the downhole tool 10, includes a fluid analyzer module 11 configured to perform one or more types of measurements on a downhole fluid of interest, which may be disposed in the formation 4 or the borehole 2. The BHA 10 may also include a sample tank 12 configured to contain a sample of the downhole fluid of interest for later retrieval and analysis at the surface of the earth 3.

A "downhole fluid" as used herein includes any gas, liquid, flowable solid and other materials having a fluid property. A downhole fluid may be natural or man-made and may be transported downhole or may be recovered from a downhole location. Non-limiting examples of downhole fluids include drilling fluids, return fluids, formation fluids, production fluids containing one or more hydrocarbons, oils and solvents used in conjunction with downhole tools, water, brine, and combinations thereof.

The BHA 10 is conveyed through the borehole 2 by a carrier 5. In the embodiment of FIG. 1, the carrier 5 is a drill string 6 in an embodiment known as logging-while-drilling (LWD). Disposed at a distal end of the drill string 6 is a drill bit 7. A drilling rig 8 is configured to conduct drilling operations such as rotating the drill string 6 and thus the drill bit 7 in order to drill the borehole 2. In addition, the drilling rig 8 is configured to pump drilling fluid through the drill string 6 in order to lubricate the drill bit 7 and flush cuttings from the borehole 2. Downhole electronics 9 may be configured to operate or control the downhole tool 10, process data obtained by the downhole tool 10, or provide an interface with telemetry for communicating with a computer processing system 19 disposed at the surface of the earth 3. Operating, controlling or processing operations may be performed by the downhole electronics 9, the computer processing system 19, or a combination of the two. Telemetry is configured to convey information or commands between the downhole tool 10 and the computer processing system 19.

In one or more non-limiting embodiments, the fluid analyzer module 11 performs reflective or transmissive spectroscopy measurements to determine a property, such as chemical composition, of a sample of the downhole fluid of interest. To obtain the sample, the downhole tool 10 includes a fluid extraction device 14 configured to extract a sample of the downhole fluid of interest from the formation 4 and dispose the sample in a fluid probe cell 15 and/or the sample tank 12. The fluid probe cell 15 may be configured to contain a static sample or to contain a continuous flow of sample fluid through the fluid probe cell 15. Spectroscopy measurements are performed on the sample while the sample is contained in fluid probe cell 15 or while the fluid is continuously pumped through the fluid probe cell 15. In one or more non-limiting embodiments, the fluid extraction device 14 includes a probe 16 configured to extend from the device 14 and seal to a wall of the borehole 2 with a pad 13. The fluid extraction device 14 includes a mechanical pump 17 configured to reduce pressure within the probe 16 causing formation fluid to flow into the probe 16 from which the fluid may be pumped into the fluid probe cell 15 and/or the sample tank 12. In one or more embodiments, the mechanical pump 17 is a positive-displacement pump, which can efficiently and accurately pump fluid at a known flow rate. In lieu of or in addition to the probe 16, the fluid extraction device 14 may include a packer (not shown) configured to isolate a portion of the borehole annulus between the exterior of the downhole tool 10 and a wall of the borehole 2. An electric motor assembly 18 is coupled to the mechanical pump 17. The electric motor assembly 18 is configured to convert electrical energy into mechanical energy in order to operate the mechanical pump 17.

Figure 2:
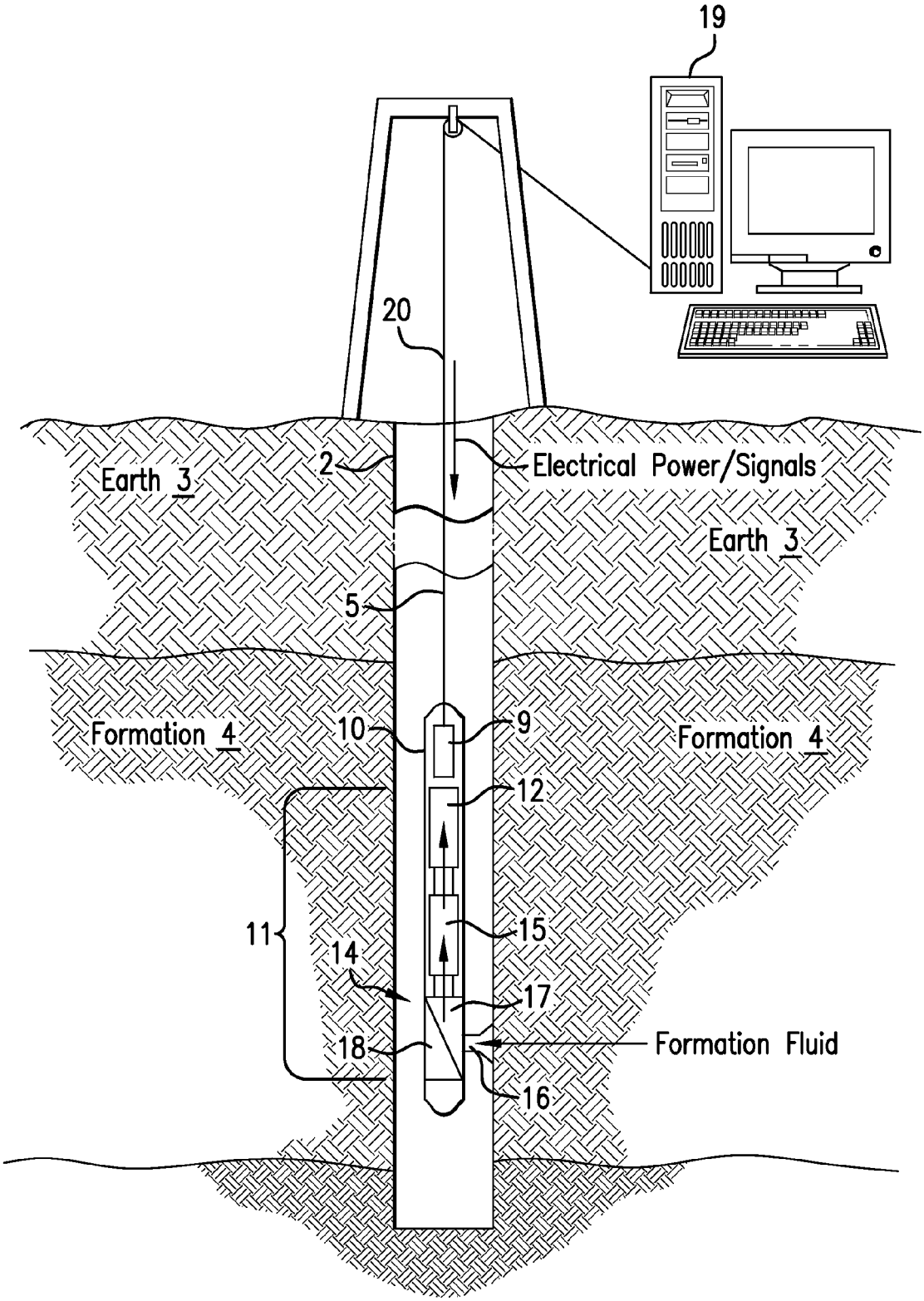
FIG. 2 illustrates an exemplary embodiment of the downhole tool conveyed through the borehole by a wireline.

FIG. 2 illustrates a cross-sectional view of an exemplary embodiment of the downhole tool 10 in an embodiment known as wireline logging. In the embodiment of FIG. 2, the carrier 5 is an armored wireline 20. The wireline may include several electrical conductors for communications between the downhole tool 10 and the computer processing system 9 and/or for transmitting electrical power from the surface of the earth 3 to the downhole tool 10.

Figure 3A:
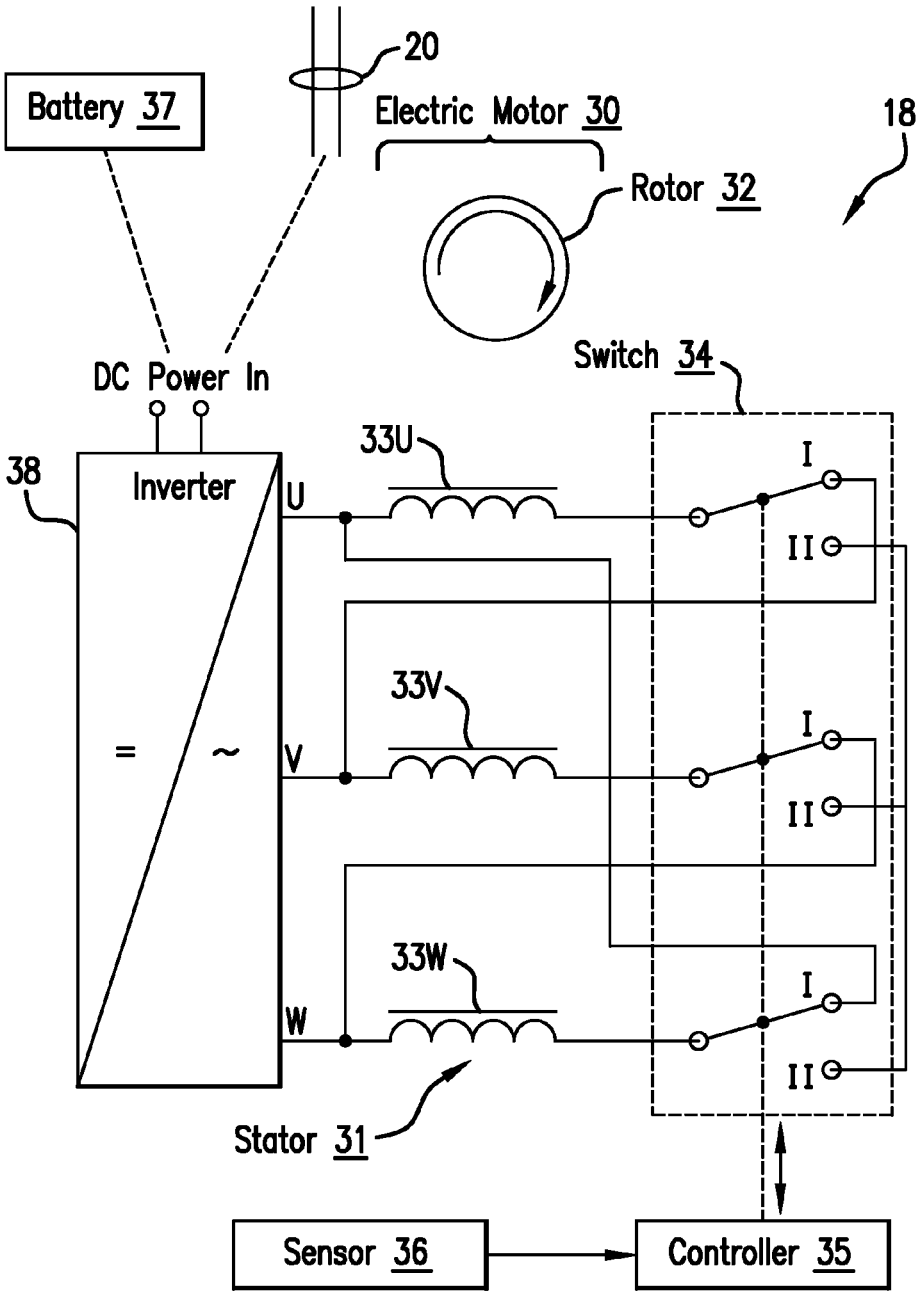
FIGS. 3A-3C, collectively referred to as FIG. 3, depict aspects of a circuit configured to control a pump in the downhole tool.

FIG. 3 depicts aspects of the electric motor assembly 18. As illustrated in FIG. 3A, the electric motor assembly 18 includes a three-phase synchronous electric motor 30 having a stator 31 and a rotor 32. The stator 31 includes conductive windings for receiving three-phase electric power. The conductive windings include a winding 33U for phase U, a winding 33V for phase V, and a winding 33W for phase W. These windings create a rotating magnetic field to turn the rotor 32 when they are energized by the three-phase electric power. The windings 33 include terminals in various locations in order to connect the windings 33 in various configurations such as a delta-configuration or a wye-configuration.

Figure 3B:
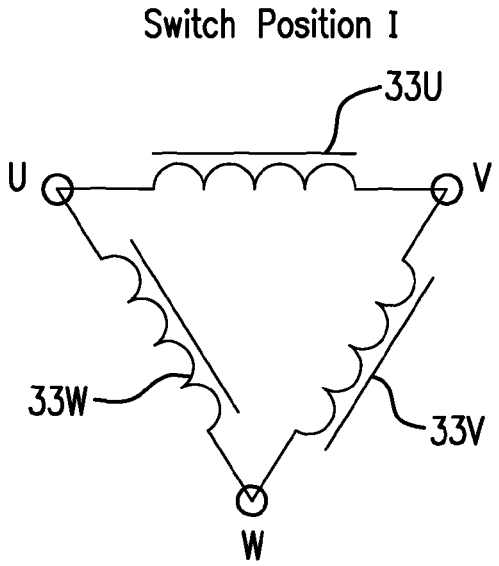
Figure 3C:
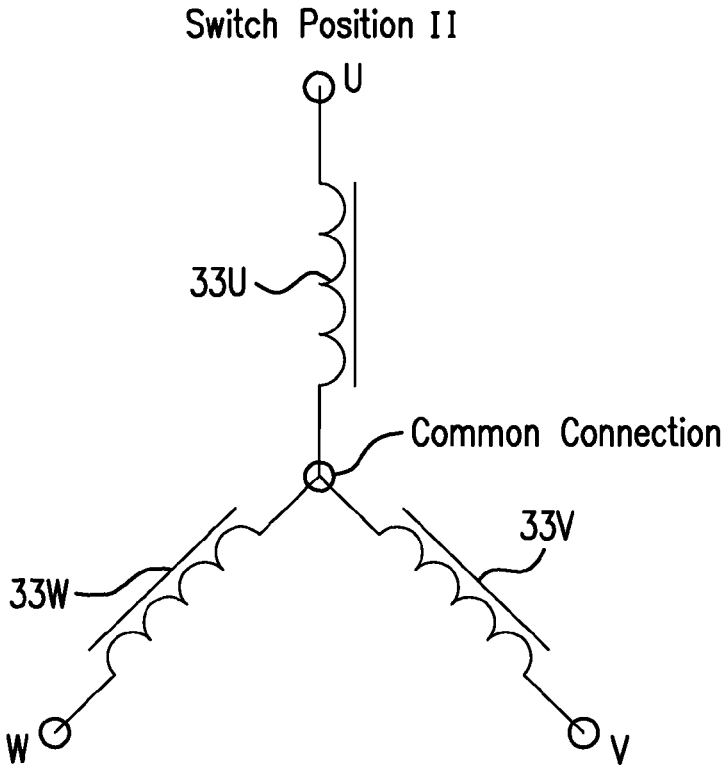

Still referring to FIG. 3, the electric motor assembly 18 includes a switch 34 configured to connect the windings 33 in the various configurations such as the delta-configuration or the wye-configuration. FIG. 3B illustrates the windings 33 in the delta-configuration resulting from the switch 34 being in position I. In the delta-configuration, each terminal of each winding 33 is uniquely connected to a terminal of another winding 33 for another phase. In other words, "uniquely connected" means for example a terminal of a first-phase winding is connected to a terminal of a second-phase winding without a third-phase winding be connected to that connection. In multi-phase windings other than three-phase, a "ring" or "circular" configuration is formed by uniquely connecting one terminal of a winding of one phase only to one terminal of another winding of another phase. FIG. 3C illustrates the windings 33 in the wye-configuration resulting from the switch 34 being in position II. In the wye-configuration, all of the windings 33 have one terminal that is commonly connected to one terminal of each of all the other windings 33. That is in other words for a three-phase system one terminal of a first-phase winding is connected to one terminal of a second-phase winding and to one terminal of a third-phase winding. The connection point is a common connection.

Referring to FIG. 3A, a controller 35 is configured to actuate or control the position of the switch 34. A sensor 36 is configured to sense a parameter of the pumping process and to provide input to the controller 35 for determining a position of the switch 34. Non-limiting examples of the sensed parameter includes pump differential pressure, pump flow rate, and desired sample tank pressure. Non-limiting embodiments of the switch 34 include a mechanical switch, an electronic switch, or a hybrid switch employing both mechanical and electronic switch technology.

Still referring to FIG. 3A, a battery 37 disposed in the downhole tool 10 supplies direct-current (DC) power to an inverter 38. The inverter 38 inverts the DC power to generate three-phase alternating-current (AC) power, which is supplied to the motor 30. In an alternative embodiment, the wireline 20 supplies DC power to the inverter 38. In yet another alternative embodiment, the wireline 20 supplies multi-phase AC power directly to the motor 30.

It is desirable to get a "clean" sample with little or no infiltrate present in the sample for analysis purposes. The clean sample insures that the infiltrate does not interfere with the analysis of the extracted formation fluid. In general, the clean-up process includes pumping the extracted fluid using a special pumping regime until the infiltrate is no longer present or under a selected amount. The special pumping regime requires precise control such as of differential pressure and draw down rate for example. For pumping purposes in the downhole tool 10, it is advantageous to use a three-phase synchronous electric motor to drive the mechanical pump 17 because of this motor's high power-density (i.e., relation between mechanical output power and size), high power efficiency (i.e., relation between mechanical output power and electric input power), and the controllability (i.e., ability to control speed, torque, or position of the motor shaft). For the application of a three-phase synchronous motor in the downhole tool 10, the differential pressure for the pump 17 depends on formation pressure, annulus pressure (i.e., pressure between tool and borehole wall), draw down depth (i.e., pressure difference by which the pump pressure goes below the formation pressure), and in the case of sampling, also on the desired overcharge pressure of the sample in the sample tank 12. The pump rate depends, amongst others, on the mobility of the extracted formation fluid, which is the ratio of viscosity of the formation fluid and the formation permeability. Requirements in regard to torque and speed result from the differential pressure and the pump speed. For downhole conditions in general, both parameters may vary over a wide range. However, there are spatial limits in regards to the pump 17 and the electric motor assembly 18 as well as limits in regard to power consumption in order for the downhole tool 10 to be conveyable in the borehole 2.

As the electrical power consumption and consequentially the mechanical power output power are restricted, a pump system (i.e. pump and motor) may either provide a high pump speed at moderate differential pressure or a moderate pump speed (i.e., less than the high pump speed) at high differential pressure (i.e., greater than the moderate differential pressure). Taking into account the space and power restrictions in downhole tools and especially in while-drilling tools, a small size three-phase motor electric motor may be used in the electric motor assembly 18. However, as downhole conditions differ from well to well or from borehole to borehole, one pump system with a specific mechanical transmission ratio might be well fitting to the speed and differential pressure range required for one specific well, while in another well, a higher pump differential pressure might be required but at a lower pump speed. The teachings disclosed herein provide a solution to this problem by providing a switchable connection to the windings 33 of the three-phase synchronous electric motor 30 to connect the windings 33 in various configurations. Each configuration provides the motor 30 with a characteristic torque, speed, current and voltage. Hence, by changing the configuration of the windings 33, these motor characteristics also change.

Using the three-phase motor as an example, with the windings 33 in the wye-connection, the motor 30 has a higher torque constant, which results in a higher torque at a given phase current compared to the delta-connection. On the other hand, the motor 30 in the wye-connection has a higher back electromotive force (emf, i.e., induced counter-voltage), which results in a lower maximum speed at a given supply voltage compared to the delta-connection. This enables the pump to achieve a higher differential pressure but a lower pump rate compared to a pump driven by a motor with a winding delta-connection. On the other hand, the motor 30 with windings 33 in a delta-connection has a lower torque constant, which leads to a lower torque at a given phase current compared to the wye-connection. In the delta-connection, the motor 30 with windings 33 has a lower back emf, which results in a higher maximum pump speed at a given supply voltage as compared to the motor 30 with windings 33 in the wye-connection. Hence, by changing the connection of configuration of the windings 33 via the switch 34, the controller 35 can select during downhole deployment between high differential pressure capability and high speed pumping capability.

Figure 4:
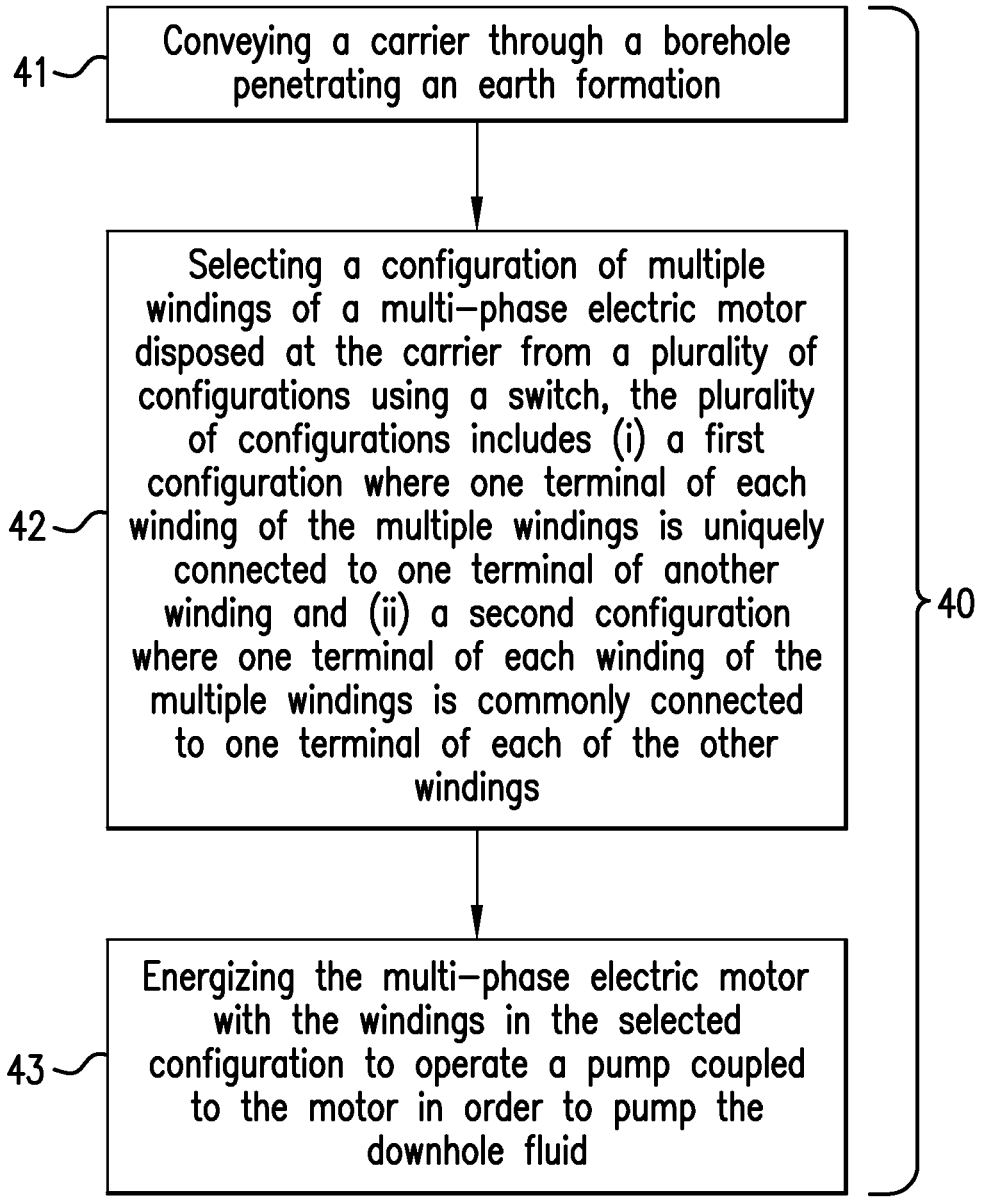
FIG. 4 is a flow chart for a method for pumping a downhole fluid.

FIG. 4 is a flow chart for a method 40 for pumping a fluid downhole. Block 41 calls for conveying a carrier through a borehole penetrating the earth. Block 42 calls for selecting a configuration of multiple windings of a multi-phase electric motor disposed at the carrier from a plurality of configurations using a switch. The plurality of configurations includes (i) a first configuration where one terminal of each winding of the multiple windings is uniquely connected to one terminal of another winding and (ii) a second configuration where one terminal of each winding of the multiple windings is commonly connected to one terminal of each of the other windings. Block 43 calls for energizing the multi-phase electric motor with the windings in the selected configuration to operate a pump coupled to the motor in order to pump the downhole fluid.

It can be appreciated that another advantage of the teachings disclosed herein is the avoidance of a multi-speed mechanical transmission between the pump 17 and the motor 30 in order to achieve a selected combination of pump differential pressure and pump speed. This type of transmission is complex and would consume valuable space in the downhole tool 10. In addition, the multi-speed transmission would be prone to failure under harsh drilling conditions due to its complexity.

It can be appreciated that while the embodiments disclosed above relate to using a three-phase synchronous motor, other multi-phase (also called polyphase) synchronous or other type electric motors may be used in accordance with the teachings disclosed herein.

In support of the teachings herein, various analysis components may be used, including a digital and/or an analog system. For example, the downhole electronics 8, the surface computer processing 9, the switch 34, the controller 35, the sensor 36, or the inverter 38 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), a feedback system for commutation of the multi-phase motor, cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list or string of at least two terms is intended to mean any term or combination of terms. The terms "first," "second" and "third" are used to distinguish elements and are not used to denote a particular order. The term "couple" relates to coupling a first component to a second component either directly or indirectly through an intermediate component. The term "disposed at" relates to a first component being disposed on or in a second component.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for pumping a downhole fluid, the apparatus comprising:

a carrier configured to be conveyed through a borehole penetrating an earth formation;

a fluid extraction device disposed at the carrier and configured to extract a sample of formation fluid from the earth formation and dispose the sample in a fluid probe cell and a sample tank;

a pump disposed at the carrier and configured to pump the sample from the formation and into the fluid probe cell and the sample tank;

a multi-phase electric motor coupled to the pump and configured to receive multi-phase electrical energy from a power source in order to operate the pump, the multi-phase electrical motor comprising multiple windings;

a switch configured to connect the multiple windings in a configuration selected from a plurality of configurations comprising (i) a first configuration where one terminal of each winding of the multiple windings is uniquely connected to one terminal of another winding and (ii) a second configuration where one terminal of each winding of the multiple windings is commonly connected to one terminal of each of the other windings;

a controller configured to operate the switch to select the first configuration or the second configuration based on a load analysis; and a sensor configured to sense a downhole parameter of a pumping process using the pump and to provide the sensed parameter as input to the controller, the sensed parameter comprising pump differential pressure, pump flow rate, or sample tank pressure, wherein the load analysis is based on the sensed parameter.

2. The apparatus according to claim 1, wherein the multiple windings comprise three windings and the first configuration is a delta-connection and the second configuration is a wye-connection.

3. The apparatus according to claim 1, wherein the multi-phase electric motor is a three-phase synchronous motor.

4. The apparatus according to claim 3, wherein the pump is a positive-displacement pump.

5. The apparatus according to claim 1, wherein the power source comprises an inverter.

6. The apparatus according to claim 5, further comprising a battery supplying power to the inverter.

7. The apparatus according to claim 5, further comprising a wireline configured to supply direct-current electrical energy from the surface of the earth to the inverter.

8. The apparatus according to claim 1, further comprising a wireline configured to supply the multiphase electrical energy from the surface of the earth to the multi-phase electrical motor.

9. The apparatus according to claim 1, further comprising a fluid analyzer module configured to analyze a formation fluid sample pumped to the module by the pump.

10. The apparatus according to claim 1, further comprising a sample tank configured to receive a formation fluid sample pumped to the tank by the pump.

11. The apparatus according to claim 1, wherein the carrier comprises a wireline, a slickline, a drill string, or coiled tubing.

12. A method for pumping a downhole fluid, the method comprising:

conveying a carrier through a borehole penetrating an earth formation;

extracting a sample of a formation fluid from the earth formation using a fluid extraction device disposed at the carrier;

selecting a configuration of multiple windings of a multi-phase electric motor disposed at the carrier from a plurality of configurations using a switch, the plurality of configurations comprising (i) a first configuration where one terminal of each winding of the multiple windings is uniquely connected to one terminal of another winding and (ii) a second configuration where one terminal of each winding of the multiple windings is commonly connected to one terminal of each of the other windings, the multi-phase electric motor being coupled to a pump disposed at the carrier and configured to pump the sample from the formation and into the fluid probe cell and the sample tank;

operating the switch using a controller configured to operate the switch to select the first configuration or the second configuration based on a load analysis; and sensing a downhole parameter of a pumping process using the pump and providing the sensed parameter as input to the controller, the sensed parameter comprising pump differential pressure, pump flow rate, or sample tank pressure, wherein the load analysis is based on the sensed parameter; and energizing the multi-phase electric motor with the windings in the selected configuration to operate the pump.

13. The method according to claim 12, further comprising selecting one of the first configuration and the second configuration not directly previously selected and energizing the multi-phase electric motor with this latest selected winding configuration.

14. The method according to claim 12, further comprising receiving an input from a sensor configured to measure a pumping parameter in order to select one of the first configuration and the second configuration.

15. The method according to claim 12, wherein the multiple windings comprise three windings and the first configuration is a delta-connection and the second configuration is a wye-connection.

16. The method according to claim 15, wherein the multi-phase electric motor is a three-phase synchronous motor.

* * * * *